United States Patent [19]

Yellin

[11] 3,948,192

[45] Apr. 6, 1976

[54] DECORATIVE STAND IN THE FORM OF A KITCHEN STEPLADDER

[76] Inventor: Bernard Yellin, 5252 S. Kolmar Ave., Chicago, Ill. 60632

[22] Filed: Mar. 10, 1975

[21] Appl. No.: 556,677

[52] U.S. Cl. ..... 108/101; 182/228

[51] Int. Cl.[2] ..... A47B 57/00

[58] Field of Search ..... 108/92, 101, 110; 182/104, 182/118, 119, 151, 228

[56] References Cited

UNITED STATES PATENTS

| | | | |
|---|---|---|---|
| 3,061,042 | 10/1962 | Giles | 182/228 X |
| 3,268,031 | 8/1966 | Hampson | 182/228 X |
| 3,476,211 | 11/1969 | Cormier | 182/228 X |

*Primary Examiner*—James C. Mitchell
*Attorney, Agent, or Firm*—Max R. Kraus

[57] ABSTRACT

A decorative stand which is formed of components so that it can be packaged and shipped in a knockdown and disassembled condition and can be readily assembled at the point of use. The stand comprises a pair of legs on each side formed of a plastic material, with each leg having outwardly and inwardly facing edges and shelf supporting ledges. The shelves are each integrally formed of plastic material and have hooking means on the opposite ends thereof. The outwardly and inwardly facing edges of the legs have recesses formed adjacent the shelf supporting ledges to permit the hooking means on the shelves to be inserted on the legs so that after insertion the hooking means engage the outwardly and inwardly facing edges of the legs to lock the shelves to the legs without the use of extraneous fastening means, yet permit removal therefrom through the recesses. The decorative stand when assembled has the appearance of a kitchen stepladder, with the shelves having upstanding borders to prevent the accidental displacement of any objects placed thereon.

7 Claims, 8 Drawing Figures

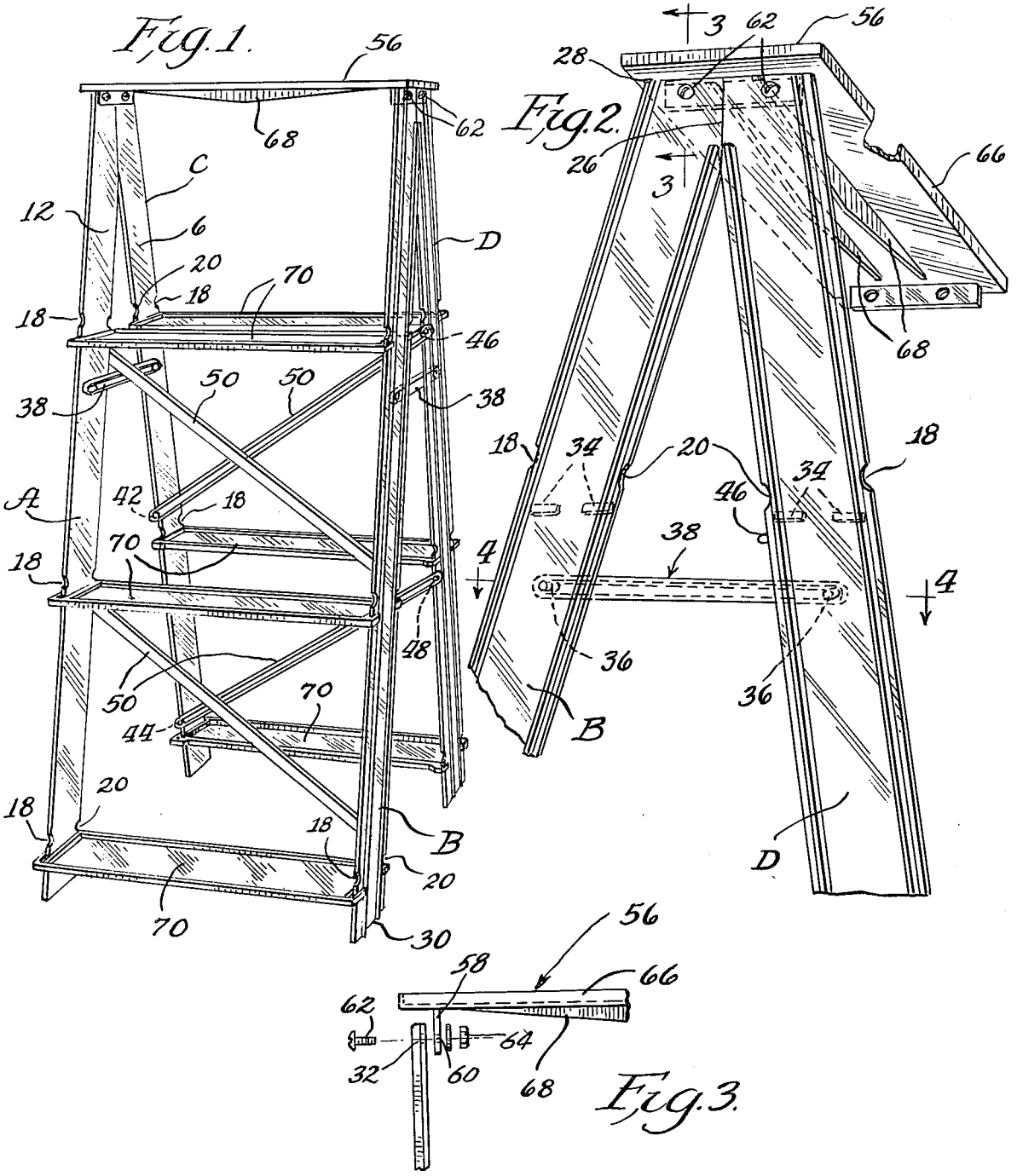
Fig. 1.
Fig. 2.
Fig. 3.
56
68
62
C
12
6
20
18
70
D
46
38
50
42
A
44
48
B
30
28
26
3
66
34
36
4
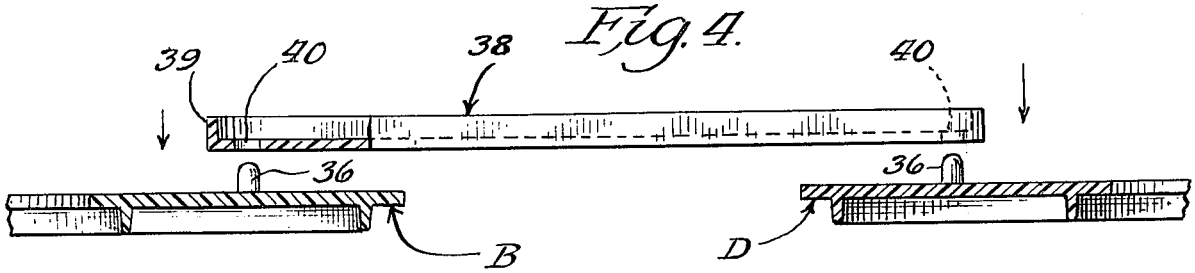
Fig. 4.
39
40
38
36
B
D Fig.5.
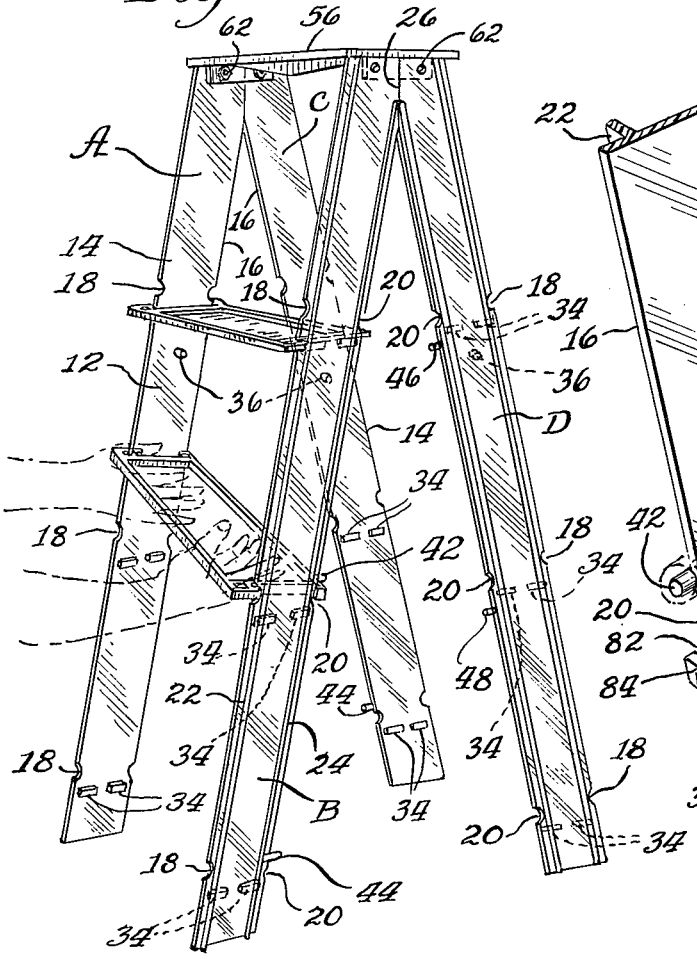
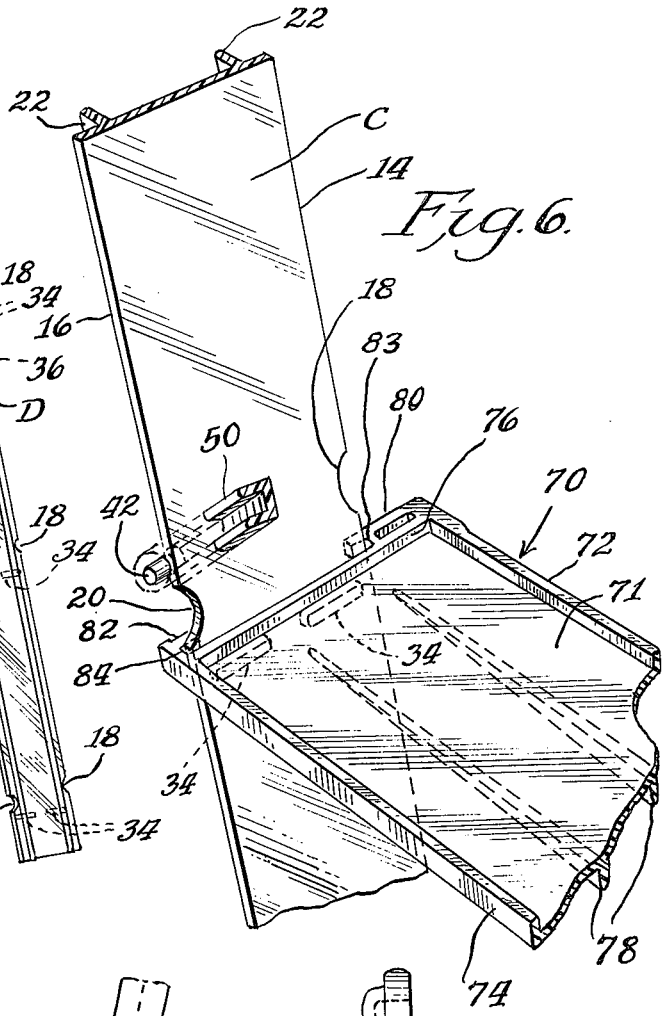
Fig.6.
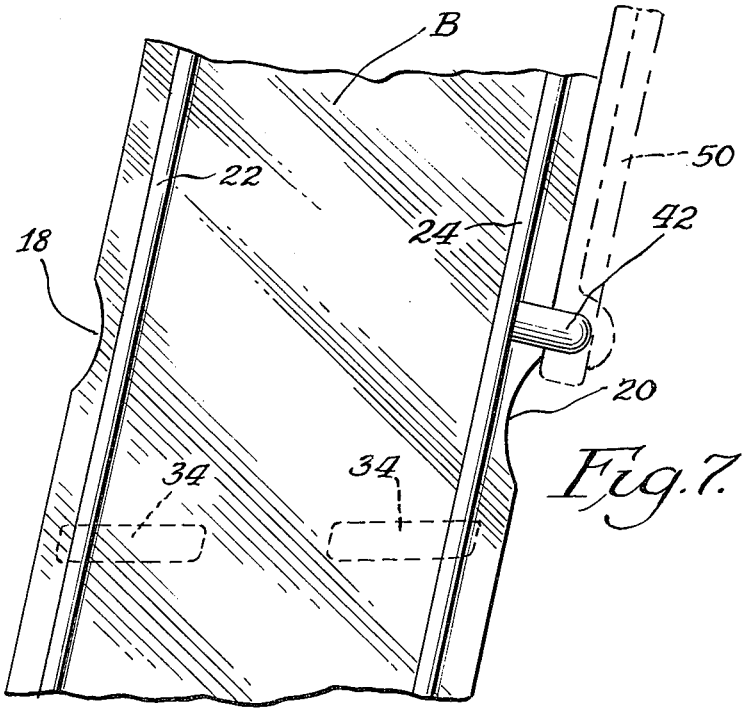
Fig.7.
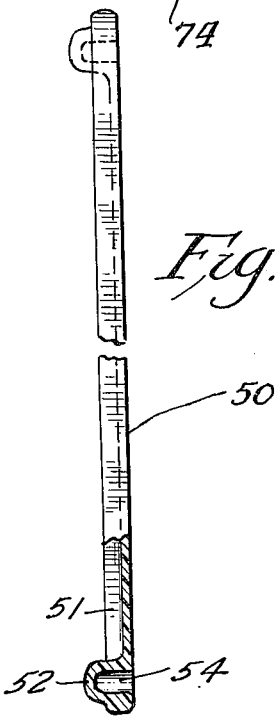
Fig.8.

DECORATIVE STAND IN THE FORM OF A KITCHEN STEPLADDER

BRIEF SUMMARY OF THE INVENTION

One of the objects of this invention is to provide a stand formed of a plurality of legs and shelves which can be crated and shipped in a disassembled condition and may be readily assembled to form a stand which in general appearance is that of a kitchen stepladder, with the steps or shelves providing surfaces on which plants and other objects may be set on and displayed.

Another object of this invention is to provide a structure of the foregoing character formed of a plastic material which may be economically produced as a minimum number of mold cavities are required to produce the various components. For example, the front leg on one side is identical to the rear leg on the other side, thus, two mold cavities can produce the four legs required for the ladder. The six shelves are all identical and can be molded from the same mold cavity. The four diagonal braces are all identical, and the two connecting bars are identical, therefore, the braces and bars may each be molded respectively from the same mold cavity, all of which reduces the production costs.

Another object of this invention is to provide a structure of the foregoing character in which the legs and shelves are so constructed that they may be interlocked merely by the positioning of one relative to the other without the use of extraneous fastening elements, and the diagonal braces and connecting bars may likewise be secured to the legs without the use of extraneous fastening elements.

Another object of this invention is to provide a structure which is made entirely of a plastic material and forms a decorative stand, which may be economically produced and which may be shipped in disassembled condition to occupy a minimum of space and may be readily assembled at the point of use.

BRIEF DESCRIPTION OF THE DRAWINGS

In the drawings:

FIG. 1 is a perspective view showing the decorative stand assembled and ready for use.

FIG. 2 is a side elevational view showing a portion of the stand.

FIG. 3 is an exploded fragmentary view of certain of the parts taken on line 3—3 of FIG. 2.

FIG. 4 is a view partly in section taken on line 4—4 of FIG. 2.

FIG. 5 is a perspective view showing the stand being assembled.

FIG. 6 is a view broken away, showing one of the legs and the shelf.

FIG. 7 is a fragmentary outside elevational view of one of the legs and showing the rearwardly extending pin to which the crossbrace is secured; and FIG. 8 is a side elevational view of the diagonally positioned cross-brace.

The decorative stand, generally indicated at 10, shown in assembled condition in FIG. 1, has four legs indicated by the letters A, B, C and D, all molded of a plastic material. The legs A and D are identical and the legs B and C are identical, therefore, two mold cavities are used for producing the four legs. In the main, the four legs are generally similar and similar parts will be identified by the same reference characters with the differences pointed out in specific detail.

Each leg has a flat wall surface 12 having an outwardly facing longitudinal edge 14 and an inwardly facing longitudinal edge 16, the said longitudinal edges being so defined by virtue of the fact that when the legs are secured together the longitudinal edges will face in the aforesaid manner. The outwardly facing edge 14 is provided with a plurality of spaced notches or recesses (three shown), all indicated at 18, which are curvilinear in shape. The inwardly facing edge 16 is likewise provided with a plurality of spaced notches or recesses (three shown), all indicated at 20, which are of similar shape. Each pair of outwardly and inwardly facing notches or recesses 18 and 20 will be in horizontal alinement when each pair of legs are in assembled relation and they serve to permit the insertion of the shelf, as will be subsequently described.

Adjacent the outer and inner longitudinal edges 14 and 16 but spaced inwardly thereof are longitudinally extending outwardly facing ribs 22 and 24 respectively which extend substantially at right angles or perpendicular to the plane of the flat surface 12. These ribs in addition to serving as a decorative function also serve to strengthen each of the legs. The rib 22 of each leg extends from adjacent the top to the bottom, while the rib 24 does not extend to the top of the leg for the reason now to be described.

The upper inner edge 26 of each leg extends at an angle different from the angle of the longitudinal edge 16 so that when two adjacent legs A and C and B and D are positioned to form their respective sides, the upper inner edges 26 will be adjacent each other and will extend in a vertical plane and the opposite legs on each side will slant or incline outwardly from the top toward the bottom. Each leg has a flat top edge 28 and a flat bottom edge 30 which extend on horizontal planes when the legs are connected. The upper end of each leg has an opening 32 for accommodating fastening elements.

Formed integrally with the wall surface 12 of each of the legs and facing inwardly are spaced ledges or ribs 34 which are at an inclined angle with respect to the longitudinal axis of the leg but which extend in a horizontal plane when the pairs of legs are assembled. The ledges or ribs 34 are the means on which the shelves rest, as will be hereinafter described. The flat wall surface 12 of each leg has an inwardly facing projection or pin 36 integrally formed therewith which is adapted to receive the connecting member or connecting bar formed of plastic, generally indicated at 38, which connects an adjacent pair of legs on each side. The connecting bar has a continuous flange 39 for strengthening same and a spaced opening 40 adjacent each of its opposite ends and is adapted to be pressed onto the inwardly projecting pins 36 to connect the two legs when they are in assembled or standing position. The inwardly extending longitudinal edges 16 of each of the legs is provided with a pair of spaced inwardy facing projections or pins integrally formed with said leg. The upper and lower pins of legs B and C are in the same relative positions and are designated respectively at 42 and 44. The upper and lower pins of legs A and D are likewise in the same relative positions and are designated respectively at 46 and 48. A pair of braces generally indicated at 50 are secured to the pins of a pair of legs by pressing same thereon, as will be described.

The brace 50 has a continuous flange 51 for strengthening same, with the opposite ends of the brace having bosses 52 which are recessed as at 54 so that the braces may be pressed on the pins to be secured thereto for bracing each pair of legs. As best seen in FIG. 1, two braces are diagonally positioned between legs A and B, with the upper brace 50 attached to pins 46 and 42 of legs A and B. The lower brace 50 is also diagonally positioned between the same legs and secured to pins 48 and 44 respectively. The same arrangement is used with respect to the cross-braces 50 between legs C and D.

The top shelf designated at 56 and molded of plastic material has an inwardly offset depending flange 58 adjacent each side, provided with spaced openings 60, which openings are alined with the leg openings 32 to each receive a fastening member such as a bolt or screw 62 which is secured thereto by means of a nut 64. This is the only shelf which is held secured to the legs by separate fastening elements. The top shelf 56 has a continuous upwardly extending border or flange 66 along the sides and ends and the underside is provided with spaced downwardly extending cross-ribs 68 which are of elongated triangular shape, the said ribs giving rigidity to the shelf and also being decorative.

All of the remaining shelves are also molded of a plastic material and are of identical construction and are each designated at 70. They are generally of rectangular shape, having a bottom wall 71 with front and rear upwardly extending flanges 72 and 74 respectively, and spaced side or end flanges 76. Said flanges 72, 74 and 76 form a continuous border around the bottom wall 71 so that a plant or other object placed on the shelf is prevented from slipping off the shelf. The underside of the bottom wall of the shelf is provided with spaced longitudinally extending ribs 78 of elongated trinagular shape which is ornamental and also serves to give greater rigidity to the shelf.

The opposite sides or opposite ends of the shelf are each formed with front and rear hooks, the front hooks being designated at 80 and the rear hooks at 82. Said hooks are integrally formed with the shelf and extend laterally from the opposite sides or ends of the shelf. The front hooks are formed from the material which extends outwardly from the opposite end and are provided with a recess or groove 83 facing inwardly in the direction of the rear of the shelf. The front hooks 80 are longer and extend a greater distance from the front of the shelf than do the rear hooks 82. The rear hooks are likewise formed from an extension of the material of the rear of the shelf and provided with a recess or groove 84 which faces forwadly toward the front of the shelf, that is, both grooves face inwardly.

The parts are shipped disassembled and collapsed and the two pairs of legs A and C on one side, and B and D on the other side may be readily secured to the top shelf 56 by positioning the pairs of legs adjacent each other, as shown in FIG. 2, and with the openings 32 at the top of the legs in alinement with the openings 60 in the depending flange 58 of the top shelf, the fastening members 62 are passed therethrough to lock the legs relative to each other and to the top shelf and are then secured by the nuts 64. This is usually done with the top shelf 56 resting in an inverted position on the floor and then securing the legs in the manner described. After the legs are secured on both sides the connector members 38 can be secured between each pair of legs on each side and said connector members will hold the legs in rigid position with respect to each other. The shelves 70 are then secured to the legs in the following manner.

Each shelf 70 is positioned so that the front and rear hooks 80 and 82 thereof are positioned adjacent the notches or recesses 18 and 20 respectively of each leg. This permits the grooves 83 and 84 of the hooks 80 and 82 respectively to be alined with the outwardly and inwardly facing longitudinal edges 14 and 16 of each leg and when thus alined the shelf is then moved downwardly past the notches where the underside of the shelf 70 engages and rests on the ledges or ribs 34. This locks each of the shelves to each of the legs on the opposite sides of the shelf. The shelves will then be supported in a horizontal manner and various objects can be supported thereon.

If it is desired to remove the shelf, the shelf is slid upwardly until the hooks are in alinement with the notches and this permits disengagement of the shelf from the legs. In this manner each of the shelves may be positioned and detachably secured to the side legs without any fastening means. The shelves have their self-contained locking means. The diagonal cross-braces 50 are then applied in the manner previously described. Thus, it is possible to provide an ornamental and decorative display stand which may be shipped in a disassembled condition and readily assembled without the use of any tools and in a minimum of time.

The parts are molded of a crystal polystyrene material which may be transparent or opaque or may be colored to suit the decorative arrangement desired. The overall shape of the stand is that of a kitchen step-ladder.

What is claimed is:

1. A decorative stand which is formed of components so that it can be packaged and shipped in a knockdown and disassembled condition and can be readily assembled at the point of use, said stand comprising a pair of oppositely positioned front legs and oppositely positioned rear legs, each leg having a generally flat wall surface, each of said legs formed of a plastic material, each leg having outwardly and inwardly facing edges and shelf supporting ledges formed integrally with each said leg, one or the other of said facing edges having a recess or notch positioned above and in close proximity to its shelf supporting ledge, a shelf adapted to rest on said shelf supporting ledges, said shelf having opposite ends, each of said opposite ends having integrally formed front and rear hooks which provide grooves facing each other, said hooks insertable in said recesses or notches of the facing edges of the legs when said shelf is initially connected to said leg, said shelf being moved to a position below said recesses or notches and to rest on said ledge when in secured supporting position with the grooves of the hook engaging the facing edges of legs and with the hook extending exteriorly around the exterior of the facing edges of the leg to detachably engage the pair of oppositely positioned legs.

2. A decorative stand as set forth in claim 1 in which the outwardly and inwardly facing edges of each of the legs having spaced recesses or notches adjacent the shelf supporting ledges which are engaged by the hooks of each of the shelves to permit installation and removal of the shelves with respect to the legs and in which the shelves are each integrally made of plastic.

3. A decorative stand as set forth in claim 2 in which the shelves each have a bottom wall and an upstanding lip or flange providing a border for said shelf to prevent accidental displacement of an object placed thereon.

4. A decorative stand as set forth in claim 1 in which each pair of front and rear legs supports a plurality of detachable shelves and in which each of the legs is provided with inwardly extending projections and integrally formed therewith in which a diagonally positioned bracing bar is detachably secured between each pair of legs which support the same shelves.

5. A decorative stand as set forth in claim 1 in which the stand formed is shaped similar to a kitchen stepladder, with the front and rear legs on each side abutting each other at the top and diverge therefrom toward the bottom and in which a top shelf has depending flanges to which the tops of the legs are detachably secured.

6. A decorative stand as set forth in claim 5 in which the top shelf is integrally formed of plastic and in which the top shelf has an upwardly extending flange or lip forming a border to prevent accidental displacement of any object placed thereon.

7. A decorative stand as set forth in claim 5 in which there are two pairs of legs, with each pair being identical, one pair comprising the front leg on one side and the rear leg on the other side and the other pair comprising the front leg on the opposite side and the rear leg on the other side with each such pair of legs formed in the same mold cavity.

* * * * *

UNITED STATES PATENT AND TRADEMARK OFFICE

CERTIFICATE OF CORRECTION

PATENT NO. : 3,948,192

DATED : April 6, 1976

INVENTOR(S) : Bernard Yellin

It is certified that error appears in the above-identified patent and that said Letters Patent are hereby corrected as shown below:

In claim 2, line 60 (3rd line of claim) the word "having" should read --have--.

In claim 4, line 4, the word "and" should be deleted; in line 5, after "therewith" the word --and-- should be inserted.

Signed and Sealed this

*eighth* Day of *June 1976*

[SEAL]

*Attest:*

RUTH C. MASON
*Attesting Officer*

C. MARSHALL DANN
*Commissioner of Patents and Trademarks*